United States Patent [19]

Walton

[11] Patent Number: 4,647,066

[45] Date of Patent: Mar. 3, 1987

[54] ORTHOPEDIC CHAIR

[76] Inventor: Edward J. Walton, 39 Farber Dr., West Babylon, N.Y. 11704

[21] Appl. No.: 773,557

[22] Filed: Sep. 9, 1985

[51] Int. Cl.[4] ..... A47C 15/00

[52] U.S. Cl. ..... 280/657; 280/47.4; 297/354; 297/409; 297/DIG. 4

[58] Field of Search ..... 297/354, 355, DIG. 4, 297/409, 407; 280/647, 650, 242 WC, 289 WC, 47.38, 47.4, 657

[56] References Cited

U.S. PATENT DOCUMENTS

| | | | |
|---|---|---|---|
| 531,330 | 12/1894 | Potter | 280/47.4 X |
| 2,535,212 | 12/1950 | Johnson | 297/130 X |
| 3,216,738 | 11/1965 | Bockus | 280/30 |
| 3,497,259 | 2/1970 | Sherfey | 297/DIG. 4 X |
| 3,640,571 | 2/1972 | Keropian | 297/DIG. 4 X |
| 3,761,126 | 9/1973 | Mulholland | 297/DIG. 4 X |
| 3,764,156 | 10/1973 | Nepper et al. | 280/47.37 R |
| 3,764,180 | 10/1973 | Mulholland | 297/488 X |
| 4,073,537 | 2/1978 | Hammersburg | 297/DIG. 4 X |
| 4,555,121 | 11/1985 | Lockard et al. | 280/648 X |

*Primary Examiner*—John J. Love
*Assistant Examiner*—Michael Mar
*Attorney, Agent, or Firm*—Michael I. Kroll

[57] ABSTRACT

An orthopedic chair for a physically impaired person is provided and consists of a seat, backrest, armrests, footrests and a tray that are readily adjustable in various attitudes to conform to the unique requirements of the physically impaired person. The chair also has casters and an adjustable rear handle so that the chair can be portable.

8 Claims, 11 Drawing Figures

ORTHOPEDIC CHAIR

BACKGROUND OF THE INVENTION

1. Field of Invention

The instant invention relates generally to chairs and more specifically it relates to an orthopedic chair that is both adjustable and portable.

2. Description of the Prior Art

Numerous chairs have been provided in prior art that are adapted to adjustably conform to people sitting in the chairs. For example U.S. Pat. Nos. 3,288,525; 3,554,599; 3,877,750; 3,990,742; 4,017,118; 4,108,492; 4,367,897 and 4,437,702 all are illustrative of such prior art. While these units may be suitable for the particular purpose to which they address, they would not be suitable for the purposes of the present invention as heretofore described.

SUMMARY OF THE INVENTION

A principle object of the present invention is to provide an orthopedic chair whose seat and backrest are readily adjustable in various attitudes to conform to the unique requirements of a physically impaired person.

Another object is to provide an orthopedic chair that has a tray, armrests and footrests that are also readily adjustable in various attitudes.

An additional object is to provide an orthopedic chair that has casters and an adjustable rear handle so that the chair can be portable to be moved into different environments.

A further object is to provide an orthopedic chair that is economical in cost to manufacture.

A still further object is to provide an orthopedic chair that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
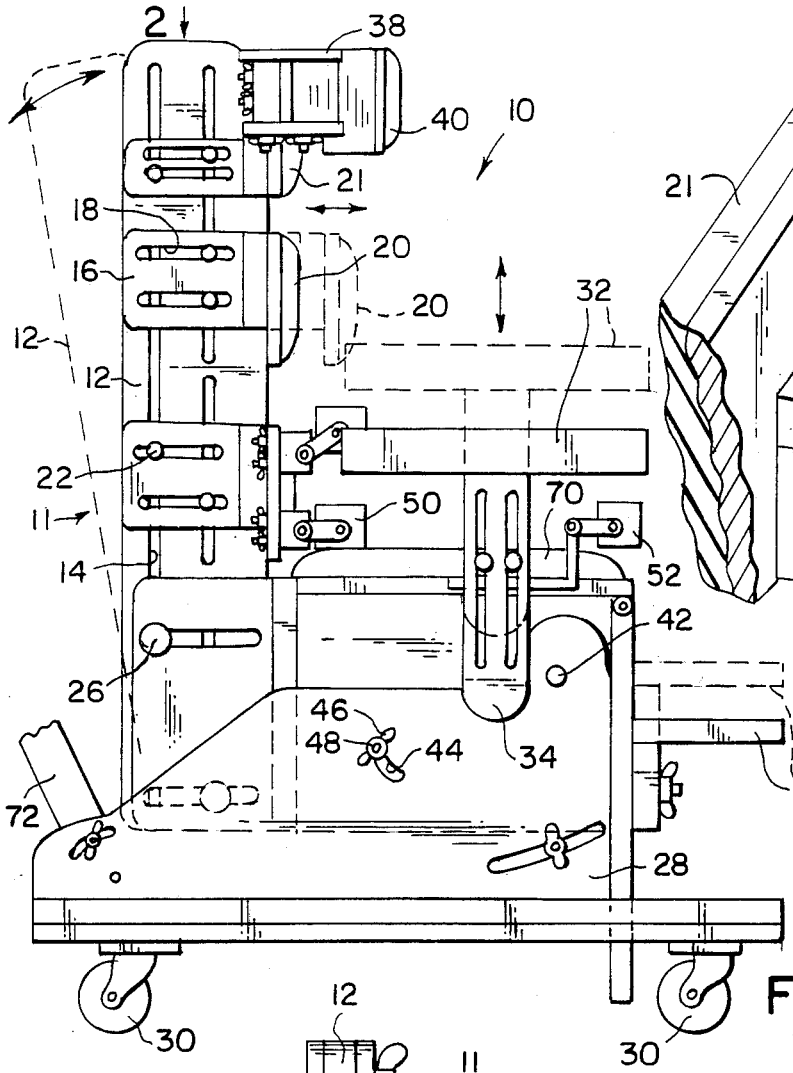
FIG. 1 is a side view of the invention showing various attitudes in phantom.
Figure 3:
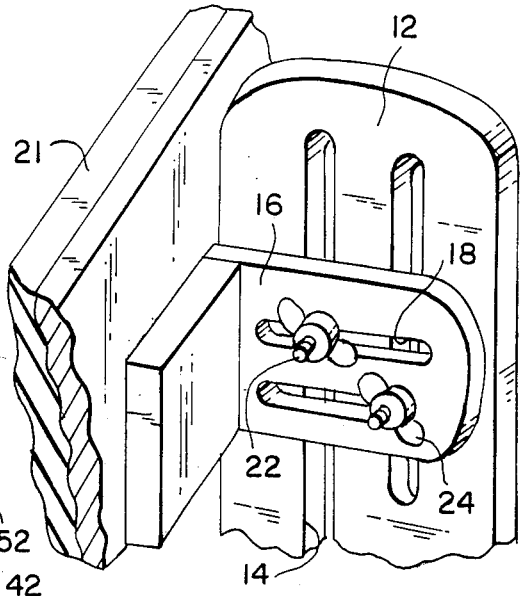
FIG. 3 is a perspective view of the upper portion of the backrest.
Figure 2:
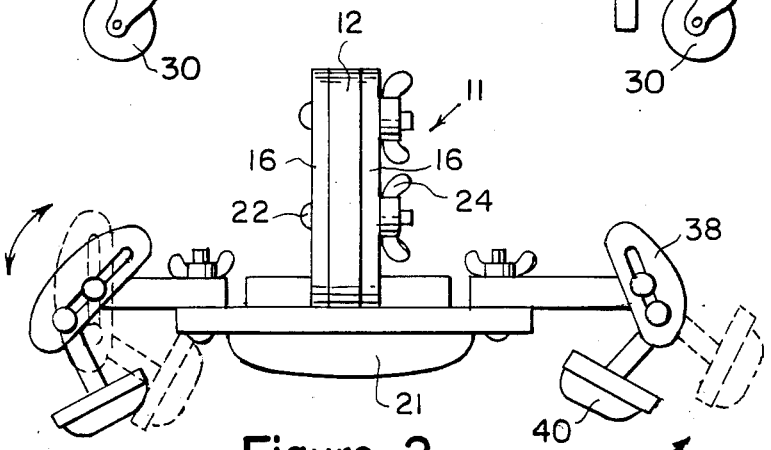
FIG. 2 is a top view of the backrest showing various attitudes in phantom.

Turning now descriptively to the drawings, in which similar reference characters denote similar elements throughout the several views, FIGS. 1 through 11 illustrates an orthopedic chair 10 for a physically impaired person (not shown).

The chair 10 includes a base member 28, a padded seat 70, a backrest 11, and back pads 20. The padded seat 70 is on top of the base member 28. The backrest 11 has a substantially vertical and adjustable stantion 12 supported by the base member with bolts 26. The stantion 12 is positioned transversely to the back of the physically impaired person. The back pads 20 are adjustably affixed via braces 16 having horizontal slots 18 to the stantion 12 having vertical slots 14 by bolts 22 and wing nuts 24. The back pads 20 engage the back of the physically impaired person in various attitudes as shown in phantom.

Casters 30 are mounted to underside of the base member 28 making the chair 10 portable. A handle 72 is pivotally mounted to the rear portion of the base member 28 so that another person (not shown) may manually push the chair 10.

The seat 70 is adjustably affixed to the base member 28 by pivot pin 42 and bolt 48 extending through curved slot 44 in the base member with wing nut 46. The seat 70 can be positioned in various attitudes.

Two foot rests 36, 36 are independently adjustably affixed to front of the base member 28. Each of the foot rests can be properly adjusted to needs of the physically impaired person.

Two arm rests 34, 34 are each adjustably affixed to one side of the base member so that they can be properly adjusted to needs of the physically impaired person.

A tray 32 slidably engages with the armrests 34, 34 so that the physically impaired person can utilize the tray 32 as a table top.

A headrest pad 21 is adjustably affixed in the same manner as the back pads 20, to the upper portion of the stantion 12 to engage head of the physically impaired person in various attitudes.

A pair of side head pads 40, 40 are each adjustably affixed via adjustment member 38 to one side of the headrest pad 21. The side head pads 40, 40 can be properly adjusted to needs of the physically impaired person.

A pair of side body pads 50, 50 are each adjustably affixed to one side of each of the back pads 20. Each of the side body pads can be properly adjusted to needs of the physically impaired person.

Figure 9:
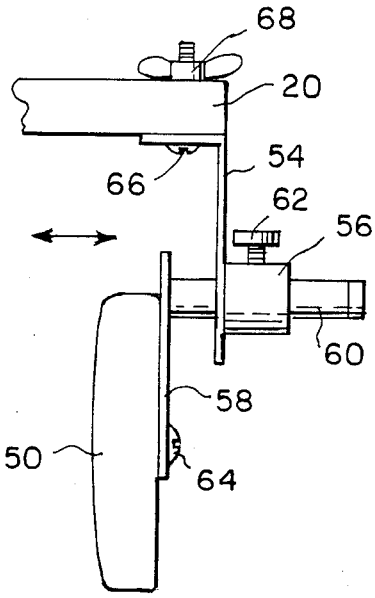
FIG. 9 is an enlarged top plan view of one of the side body pads.
Figure 8:
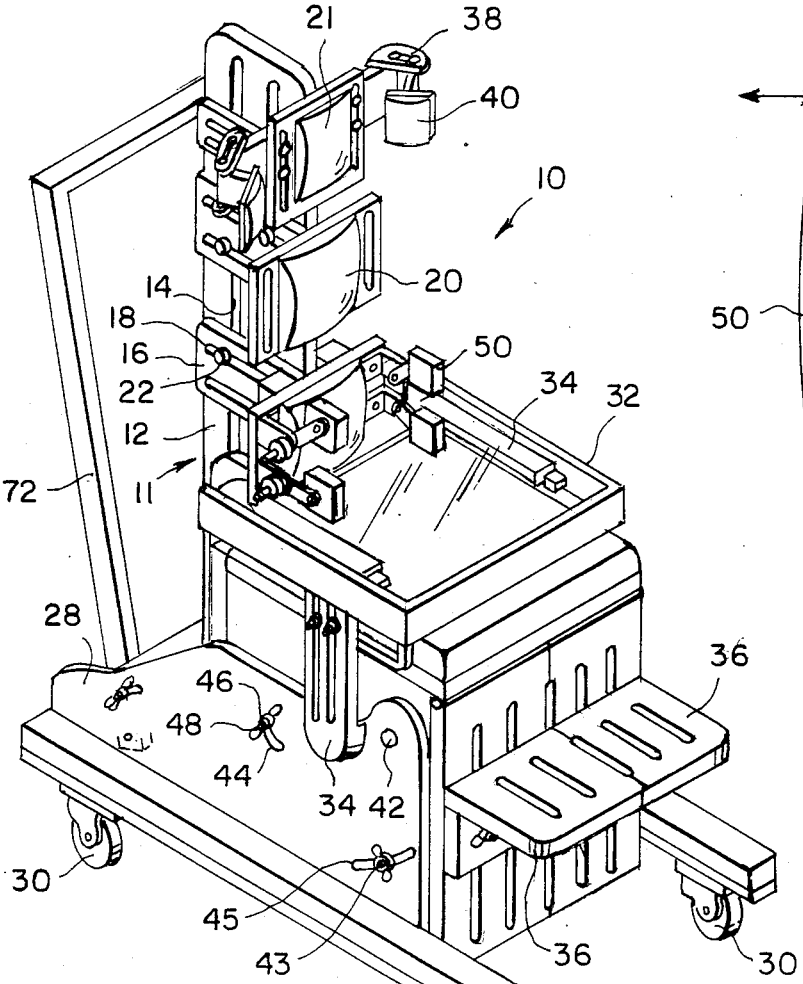
FIG. 8 is a perspective view of the invention.
Figure 11:
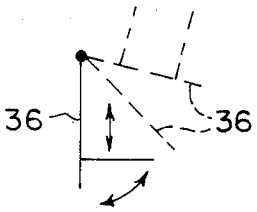
FIG. 11 is a diagrammatic view of the various adjustable positions of one of the foot rests.
Figure 10:
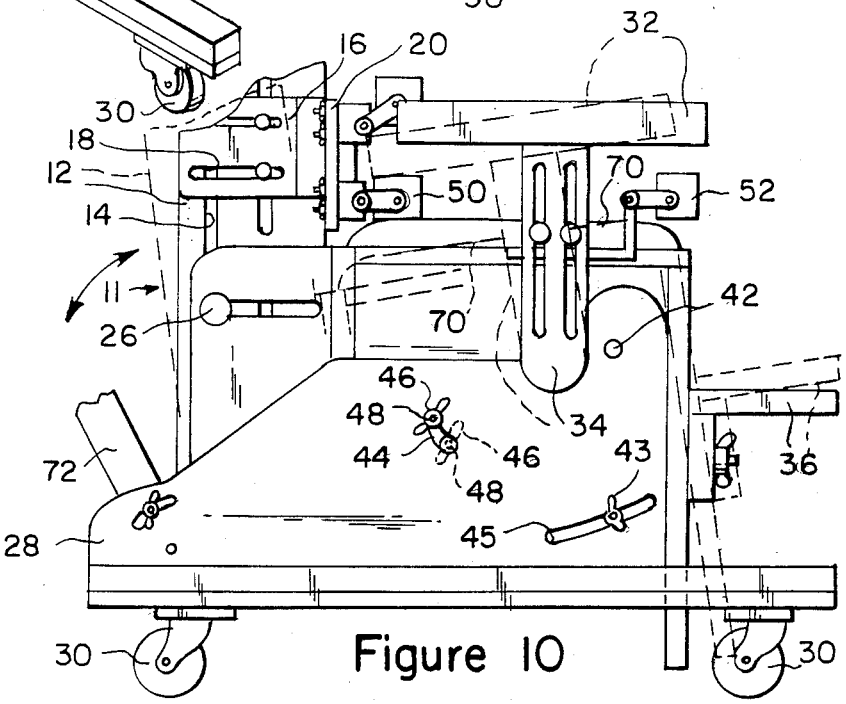
FIG. 10 is a side view with parts broken away of the invention showing additional various attitudes in phantom.

As best seen in FIG. 9, a typical side body pad 50 is affixed by a bolt 64 to a pad brace 58 that has a transverse adjustment rod 60. The adjustment rod slides within a sleeve 56 that has a securement bolt 62. The sleeve 56 is attached transversely to one arm of an L-shaped back brace 54 with other arm of the back brace secured to the back pad 20 via bolts 66 and wing nuts 68.

A pair of side leg pads 52, 52 are each adjustably affixed to one of the arm rests 34. Each of the side leg pads can be properly adjusted to needs of the physically impaired person.

Figure 7:
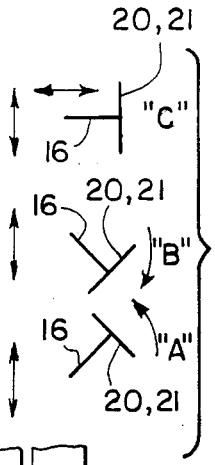
FIG. 7 is a diagrammatic view of the various adjustable positions as shown in FIGS. 4 through 6.
Figures 4, 5, 6:
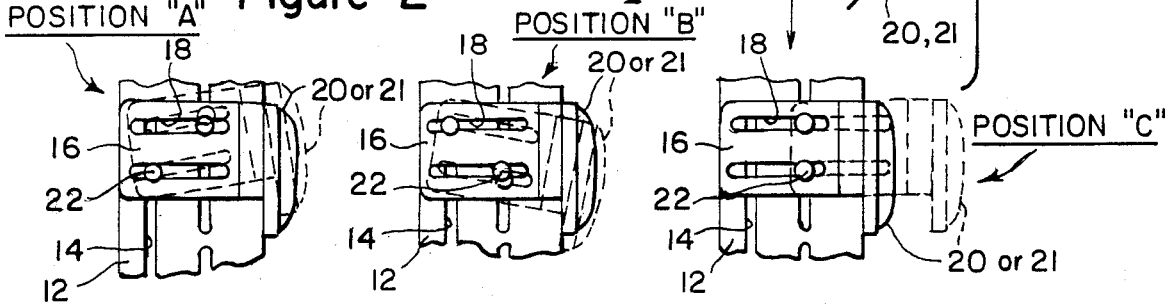
FIGS. 4 through 6 are side views of part of the packrest in various adjustable positions in phantom.

The back pad 20 and/or headrest pad 21 can tilt in an upward attitude as shown in position "A" in FIGS. 4 and 7 by off setting the bolts 22 with upper bolt to the right.

The back pad 20 and/or headrest pad 21 can tilt in a downward attitude as shown in position "B" in FIGS. 5 and 7 by off setting the bolts 22 with upper bolt to the left.

The back pad 28 and/or headrest pad 21 can move in a horizontal attitude as shown in postion "C" in FIGS. 6 and 7 by aligning the bolts 22 one above the other.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An orthopedic chair for a physically impaired person which comprises:

(a) a base member;

(b) a padded seat on top of said base member;

(c) a substantially vertical planar brace member secured to a rear portion of said base member and extending transversely to said padded seat, said planar brace member having a pair of vertically spaced, horizontally extending slots;

(d) a stantion extending substantially vertically from the rear portion of said base member, said stantion having a substantially rectangular configuration with opposed planar surfaces positioned transversely with respect to said padded seat and a plurality of slots arranged in two parallel rows extending along the vertical length of said stantion;

(e) a back pad having a planar brace member extending transversely therefrom and a pair of vertically spaced, horizontal slots extending through said brace member;

(f) a pair of side body pads, each of said side body pads being adjustably affixed to one side of said back pad;

(g) a headrest pad having a planar brace member extending transversely therefrom and a pair of vertically spaced, horizontal slots extending through said brace member; and (h) releasable fastener means extending through the slots of said brace members and said stantion for adjustably securing said headrest and said back pad to said stantion and for adjustably securing said stantion to said base member.

2. An orthopedic chair as recited in claim 1, further comprising:

(a) a plurality of casters mounted to the underside of said base member making said chair portable; and (b) a handle pivotally mounted to the rear portion of said base member so that another person may manually push said chair.

3. An orthopedic chair as recited in claim 2, wherein said seat is adjustably affixed to said base member so that said seat can be positioned in various attitudes.

4. An orthopedic chair as recited in claim 3, further comprising two foot rests that are independently adjustably affixed to the front of said base member so that each of said foot rests can be properly adjusted to the needs of said physically impaired person.

5. An orthopedic chair as recited in claim 4, further comprising a pair of armrests, each said armrest is adjustably affixed to one side of said base member so that each of said armrests can be properly adjusted to needs of said physically impaired person.

6. An orthopedic chair as recited in claim 5 further comprising a tray that slidably engages with said armrests so that said physically impaired person can utilize said tray as a table top.

7. An orthopedic chair as recited in claim 6, further comprising a pair of side head pads, each of said side head pads being adjustably affixed to one side of said headrest pad so that each of said side head pads can be properly adjusted to the needs of said physically impaired person.

8. An orthopedic chair as recited in claim 1, further comprising a pair of side leg pads, each of said side leg pads is adjustably affixed to one of said armrests so that each of said side leg pads can be properly adjusted to the needs of said physically impaired person.

* * * * *